United States Patent [19]

Shibata

[11] Patent Number: 4,766,868

[45] Date of Patent: Aug. 30, 1988

[54] METHOD AND APPARATUS FOR CONTROLLING AIR-FUEL RATIO IN INTERNAL COMBUSTION ENGINE

[75] Inventor: Norio Shibata, Toyota, Japan

[73] Assignee: Toyota Jidosha Kabushiki Kaisha, Toyota, Japan

[21] Appl. No.: 134,144

[22] Filed: Dec. 17, 1987

[30] Foreign Application Priority Data

Dec. 18, 1986 [JP] Japan ..... 61-300144

[51] Int. Cl.[4] ..... F02B 3/00

[52] U.S. Cl. ..... 123/440; 123/489

[58] Field of Search ..... 123/489, 440, 491

[56] References Cited

U.S. PATENT DOCUMENTS

| | | | |
|---|---|---|---|
| 4,345,560 | 8/1982 | Nakamuka | 123/440 |
| 4,364,357 | 12/1982 | Matsuoka | 123/440 |
| 4,450,812 | 5/1984 | Otsuka | 123/589 |
| 4,528,962 | 7/1985 | Auth | 123/489 |

*Primary Examiner*—Ronald B. Cox

*Attorney, Agent, or Firm*—Cushman, Darby & Cushman

[57] ABSTRACT

In an internal combustion engine having a carburetor fuel system wherein an amount of air bleeding is mixed with the fuel by a feedback control for adjusting an air-fuel ratio, the amount of air bleeding is regulated within a range defined by a minimum guard value and a maximum guard value, the maximum guard value is adjusted to a smaller value than the maximum guard value, and the feedback control is not interrupted when the engine is cold, the engine is in an acceleration state, and the air fuel ratio is lean.

4 Claims, 6 Drawing Sheets

METHOD AND APPARATUS FOR CONTROLLING AIR-FUEL RATIO IN INTERNAL COMBUSTION ENGINE

BACKGROUND OF THE INVENTION (1) Field of the Invention

The present invention relates to a method and apparatus for feedback control of an air-fuel ratio in an internal combustion engine having a carburetor fuel system.

(2) Description of the Related Art

At present, a three-way catalyzer is used to convert three noxious gas components contained in an exhaust gas of an engine into innocuous gas components. Namely, noxious carbon monoxide (CO) and hydrocarbon (HC) are oxidized and nitrogen oxides ($NO_2$) are deoxidized simultaneously by the three-way catalyzer into carbon deoxide ($CO_2$), water vapor ($H_2O$), and nitrogen ($N_2$) respectively. It is known that the cleaning capacity of the three-way catalyzer becomes greatest when the air-fuel ratio is at a stoichiometric air-fuel ratio.

In the prior air-fuel ratio feedback control system in an internal combustion engine having a carburetor fuel system, the $O_2$ sensor is arranged in an exhaust system and located close to a combustion chamber of the engine, i.e., the sensor is positioned at the gathering point of an exhaust manifold located upstream of the three-way catalyzer, and an air bleed pipe is connected to a fuel passage between a nozzle and a fuel reservoir of the carburetor. The air-fuel ratio in the prior internal combustion engine having a carburetor fuel system is controlled by adjusting the amount of air flowing through the air bleed pipe and mixed with the fuel in accordance with a signal output from the $O_2$ sensor. That is, when the signal output from the $O_2$ sensor indicates a lean state of the engine, the amount of the air bleeding is decreased to enrich the air-fuel ratio, and when the engine is in a rich state, the amount of air bleeding is increased to make the air-fuel ratio leaner.

However, to stabilize the running state of a cold engine, and to improve the driveability in an acceleration state and a heavy load state of the engine, the above mentioned air-fuel ratio feedback control is interrupted when the engine is in a cold state, in an acceleration state, or in a full or heavy load state.

This interruption of the air-fuel feedback control brings the air-fuel ratio to a base air-fuel ratio, which is predetermined to be on the rich side of the air-fuel ratio when the engine is in the cold state, in the acceleration state, or in the full or heavy load state, thereby increasing the HC and CO emissions. As a result, the driveability at the acceleration state and the full or heavy load state of the engine becomes worse and the fuel consumption is raised.

SUMMARY OF THE INVENTION

It is an object of the present invention to provide a method and apparatus for contorlling the air-fuel ratio in an internal combustion engine having a carburetor fuel system in which good driveability and a good fuel consumption can be realized even in the cold state, in the acceleration state, or in the full or heavy load state of the engine.

According to the present invention, a maximum guard value $I_{max}$ of an amount of air bleeding is set to a small value when the engine is cold, the engine is in an acceleration state, or the air-fuel ratio is lean, and the air-fuel ratio feedback control is not interrupted when the engine is in those states. That is, a maximum guard value $I_{max1}$ of an amount of air bleeding in a normal state is set to a maximum guard value $I_{max2}$ of an amount of air bleeding which is smaller than the value $I_{max1}$. As a result, if the amount of air bleeding becomes greater when the engine is cold, the engine is in an acceleration state, or the air-fuel ratio becomes lean, the amount of air bleeding is limited by the maximum guard value $I_{max2}$ and the air-fuel ratio will not be brought to an excessively lean state.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
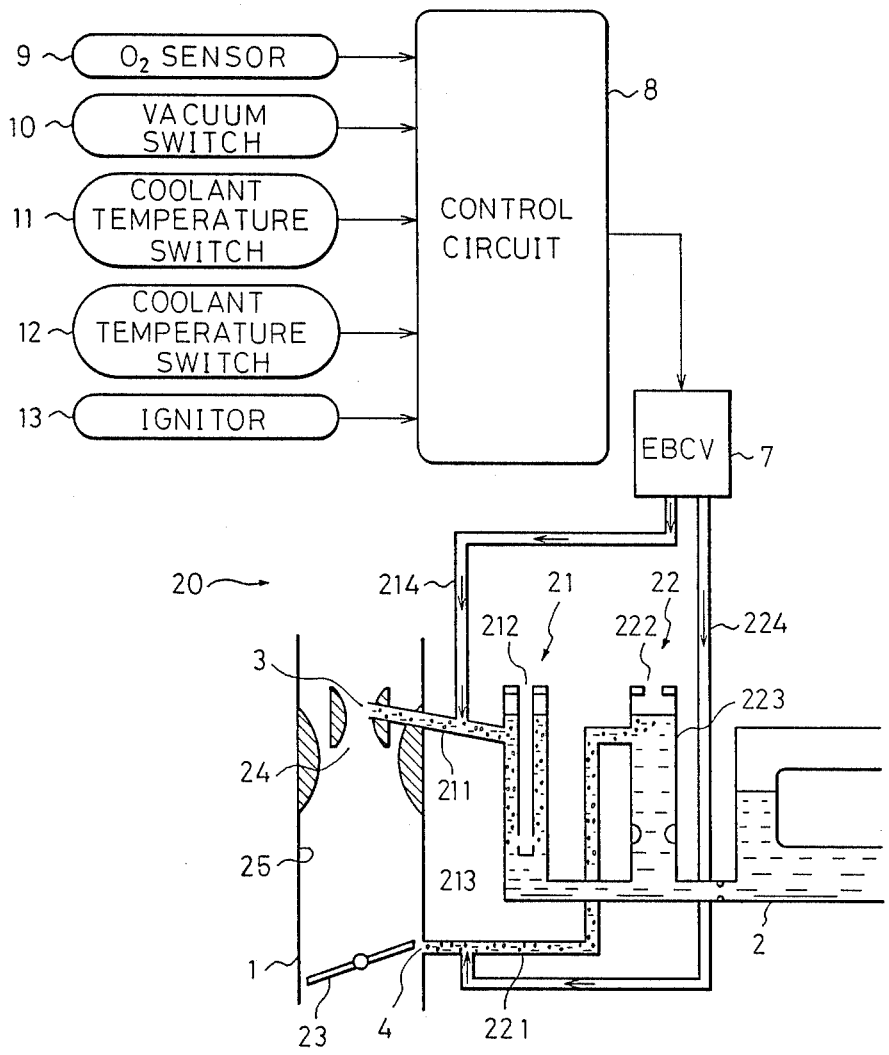
FIG. 1 is a schematic diagram of an internal combustion engine with the carburetor fuel system according to the present invention.

Referring now to the drawings, FIG. 1 shows a part of an internal combustion engine 20 provided with an electronically controlled carburetor 1. The electronically controlled carburetor 1 generally comprises a main mixture supply system 21 and a slow mixture supply system 22. The main mixture supply system 21 includes a main mixture delivery nozzle 211 having a mixture discharging end 3 opening upstream of a throttle valve 23 in a venturi portion 24 of an induction passage 25 of the engine. The slow mixture supply system 22 includes a slow mixture delivery nozzle 221 having a mixture discharging end 4 opening to the venturi portion 24 of the induction passage 25 at a position approximately adjacent to the throttle valve 23.

The main mixture supply system 21 has a main constant air bleeder 212 in which a main air-fuel mixture is created. The main constant air bleeder 212 is connected with a float chamber 2 via a main fuel passage 213, and is also connected with the nozzle 211. A variable air bleeder 214 is connected to the nozzle 211, and an electric bleed air control valve (EBCV) 7 is connected to the other end of the variable air bleeder 214. The EBCV 7 delivers a controlled amount of main air to the nozzle 211 via the air bleeder 214. The EBCV 7 has a construction well known per se and functions as an electro-magnetically controlled valve to control the amount of main air delivered via the bleeder 214.

Similar to the main mixture supply system, the slow mixture supply system 22 has a slow constant air bleeder 22 in which a slow air-fuel mixture is created. The slow constant air bleeder 222 is connected with a float chamber 2 via a main fuel passage 223, and is also connected with the nozzle 221. A variable air bleeder 224 is connected to the nozzle 221, and an electric bleed air control valve (EBCV) 7 is connected to the other end of the variable air bleeder 224. The EBCV 7 delivers a controlled amount of slow air to the nozzle 221 via the air bleeder 224.

The EBCV 7 is controlled by a control circuit 8 which accepts a plurality of control signals; for example, an output signal from an $O_2$ sensor 9, a signal from a vacuum switch 10, signals from coolant temperature switches 11, 12, and a signal from an igniter. The $O_2$ sensor 9 generates an output voltage signal in accordance with the concentration of oxygen in the exhaust gas. The vacuum switch 10 generates an ON signal when detecting a vacuum. The coolant temperature switches 11, 12 generate ON/OFF signals in accordance with changes in the temperature of the coolant of the engine. The signal from the igniter is used for calculating a rotational speed of the engine.

Figure 2:
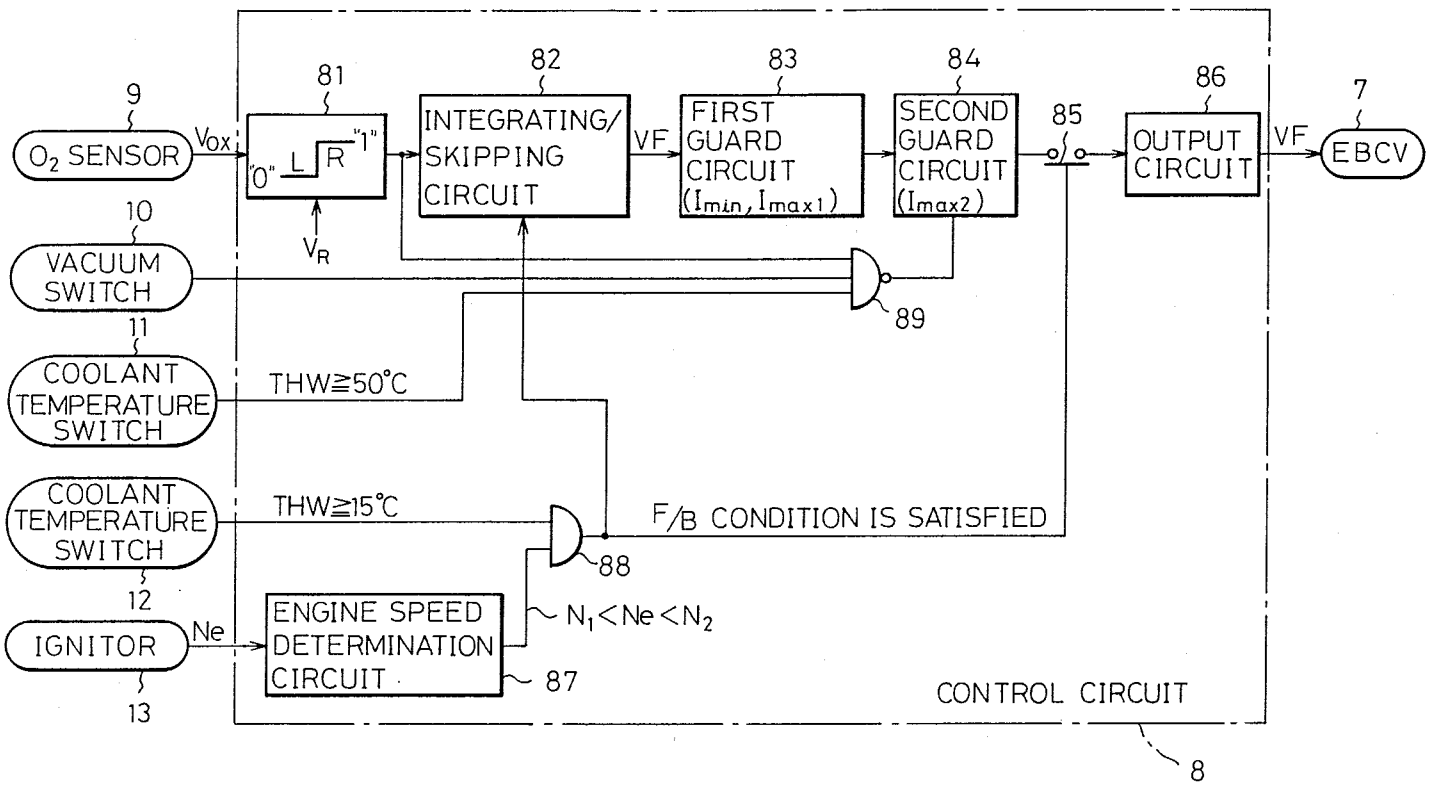
FIG. 2 is a detailed circuit diagram showing a part of the control circuit of FIG. 1.

FIG. 2 shows a specific circuit arrangement of the control circuit 8 of the present invention. In FIG. 2, the $O_2$ sensor 9, the vacuum switch 10, the coolant temperature switches 11, 12 and the igniter 13 are connected to the control circuit 8. The $O_2$ sensor 9 is connected to a comparator circuit 81, the vacuum switch 10 and the coolant temperature switch 11 are connected to a NAND circuit 89, the coolant temperature switch 12 is connected to an AND circuit 88, and the igniter 13 is connected to the AND circuit 88 via a rotational speed determination circuit 87.

The comparator circuit 81 compares an output signal $V_{OX}$ from the $O_2$ sensor 9 with a reference voltage $V_R$, for example, 0.45 V, which is delivered from a reference generating circuit (not shown). The comparator circuit 81 generates a "0" level signal when $V_{OX} \leqq V_R$ (air-fuel ratio is lean) and generates a "1" level signal when $V_{OX} > V_R$ (air-fuel ratio is rich). The signal output from the comparator circuit 81 is delivered to an integrating/skipping circuit 82 and one input terminal of the NAND circuit 89.

The integrating/skipping circuit 82 consists, for example, of an integrating circuit composed of an operational amplifier and an output of the integrating circuit skips when the output of the comparator circuit 81 is inverted. That is, when the ouput of the comparator circuit 81 is "0" level (air-fuel ratio is lean), the output VF of the integrating/skipping circuit 82 is decreased in accordance with a predetermined time constant, and when the output of the comparator circuit 81 is "1" level (air-fuel ratio is rich), the output VF of the integrating/skipping circuit 82 is increased in accordance with an another predetermined time constant. Contrary to this, when the output of the comparator circuit 81 is changed from "1" level to "0" level, the output VF of the integrating/skipping circuit 82 is greatly decreased, and when the output of the comparator circuit 81 is changed from "0" level to "1" level, the output VF of the integrating/skipping circuit 82 is greatly increased. The output VF of the integrating/skipping circuit 82 is delivered to a first guard circuit 83.

The first guard circuit 83, which includes two comparators and a selector, guards the output VF of the integrating/skipping circuit 82 within the level of $I_{min} - I_{max1}$. The output VF equals the amount of air bleed VF. One of the comparator compares the output VF of the integrating/skipping circuit 82 with the level $I_{min}$ and the other comparator compares the output VF of the integrating/skipping circuit 82 with the level $I_{max1}$. The selector selects the output VF of the integrating/skipping circuit 82 as an output of the first guard circuit 83 when the output VF is within the level of $I_{min} - I_{max1}$, although the selector selects the level $I_{min}$ or $I_{max1}$ as the output of the first guard circuit 83 when the output VF is not within the level of $I_{min} - I_{max1}$. In this way, the output VF of the integrating/skipping circuit 82 is guarded within the level $I_{min} - I_{max1}$ and delivered to a second guard circuit 84.

The second guard circuit 84 has a comparator which compares the output VF with the level $I_{max2}$ ($< I_{max1}$), and a selector which selects the output VF when $VF < I_{max2}$ and selects the level $I_{max2}$ when the output VF exceeds the level $I_{max2}$. Note, the second guard circuit 84 functions in this way only when an output of the NAND circuit 89 is "1" level. When the output of the NAND circuit 89 is "0" level, the output VF of the integrating/skipping circuit 82 passes through the second guard circuit 84 without change.

The NAND circuit 89 which decides the function of the second circuit 84, has 3 input terminals. One of these input terminals is connected to the comparator circuit 81 as mentioned before; one of the remaining terminals is connected to the vacuum switch 10 which generates the high level signal "1" when detecting a vacuum; and, the last terminal is connected to the coolant temperature switch 11 which generates the high level signal "1" when the temperature of the coolant exceeds a predetermined temperature THWR, for example, 50° C.

The high level signal "1" appears at the output terminal of the NAND circuit 89 when one of the following conditions is satisfied.

(1) The output level of the comparator 81 is low level "0"; i.e., the output $V_{OX}$ of the $O_2$ sensor indicates a lean state of the air-fuel ratio.

(2) The output level of the vacuum switch 10 is low level "0", i.e., the engine is under a full load or heavy load.

(3) The output level of the coolant temperature switch 11 is low level "0", i.e., the temperature THW of the engine coolant is lower than a predetermined temperature, for example 50° C.

The output signal of the second guard circuit 84 is delivered to the EBCV 7 via an ON/OFF switch 85 and output circuit 86. The ON/OFF switch 85 is controlled by an output signal of an AND circuit 88, which indicates whether or not the air-fuel ratio feedback control conditions are satisfied. The output signal of the AND circuit 88 is also delivered to the integrating/skipping circuit 82. If the air-fuel ratio feedback control conditions are satisfied, the AND circuit 88 outputs the high level signal "1", and according to this high level signal "1", the integrating/skipping circuit 82 is activated and the ON/OFF switch 85 is turned ON. The air-fuel ratio feedback control conditions are as follows:

(1) the coolant temperature THW is higher than 15° C., i.e., the output signal of the coolant temperature switch 12 is high level "1", and (2) the rotational speed Ne of the engine is within the range of $N_1$–$N_2$, i.e., the output signal of a rotational speed determination circuit 87 is high level "1".

Note that the air-fuel feedback conditions are changed or added in accordance with the running condition of the engine. For example, the condition of 'a predetermined time has passed after the throttle valve 23 becomes open from fully closed position' can be added. In this way, if one of the air-fuel ratio feedback conditions is not satisfied, the air-fuel ratio is controlled by an open-loop control. As a result, if one of the air-fuel ratio feedback conditions is not satisfied, activation o the integrating/skipping circuit 82 is interrupted and the ON/OFF switch 85 is turned OFF, and thus the EBCV 7 is closed by the output circuit 86. Therefore, the amount of air bleed is decreased and the air-fuel ratio is brought to the base air-fuel ratio which is predetermined to be on the rich side of the air-fuel ratio.

According to the control circuit 8 as shown in FIG. 2, the maximum guard value $I_{max1}$ of the amount of air bleeding is changed to the value $I_{max2}$, which is smaller than the value $I_{max1}$ when the engine is cold (THW<50° C.), when the engine is at a full or heavy load, or the air-fuel ratio is lean, but the air-fuel ratio feedback control is not interrupted. As a result, if the amount of air bleeding is increased due to an instability of the air bleeding, an overlean air-fuel ratio is prevented.

Figure 3:
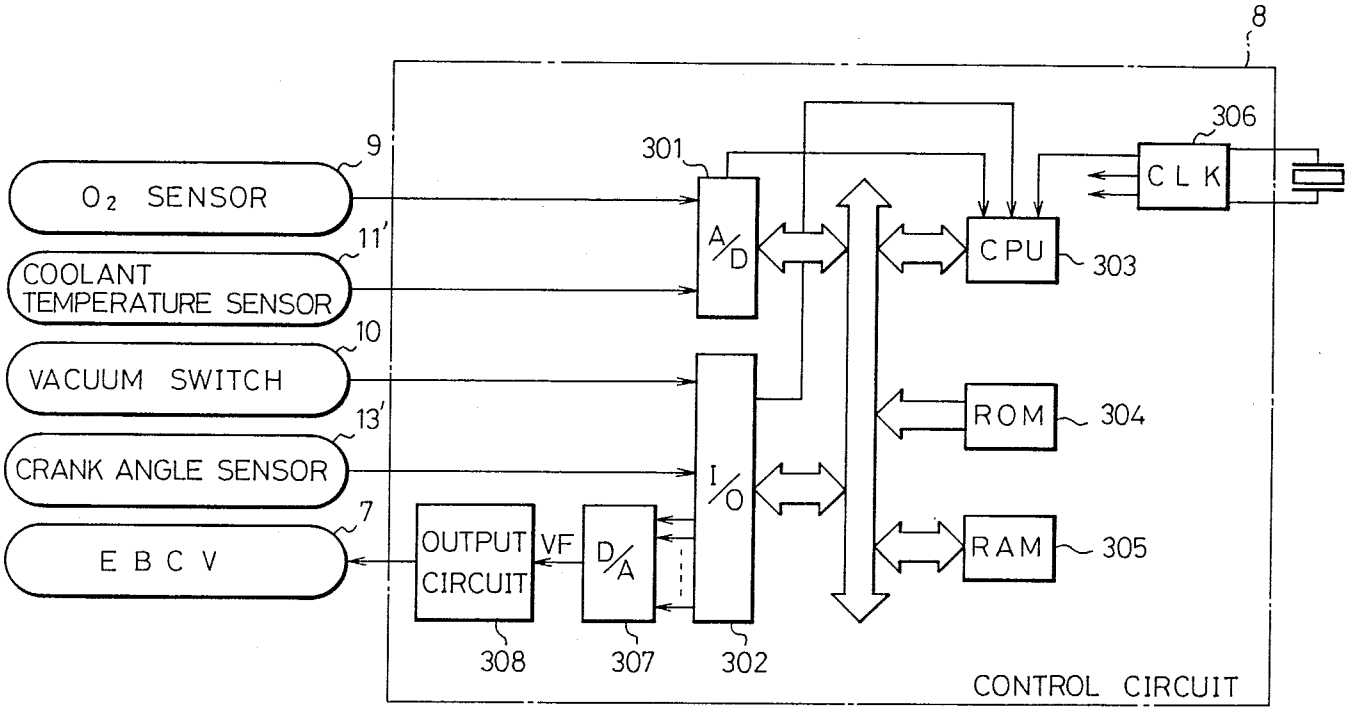
FIG. 3 is another detailed circuit diagram showing a part of the control circuit of FIG. 1.

The control circuit 8 as shown in FIG. 1 can be constructed by a microcomputer as shown in FIG. 3. The control circuit 8 includes an analog-to-digital (A/D) converter 301, an input/output (I/O) interface 302, a central processing unit (CPU) 303, a read only memory (ROM) 304 for storing a main routine, interrupt routines such as a fuel injection routine, an ignition timing routine, tables (maps), constants, etc., a random access memory (RAM) 305 for storing temporary data, a clock (CLK) generator 306, a digital-to-analog (D/A) converter 307, and an output circuit 308. The A/D converter 301, I/O interface 302, CPU 303, ROM 304, and RAM 305 are interconnected by a bus line 309. Similar to the control circuit 8 shown in FIG. 2, the $O_2$ sensor 9 and a coolant temperature sensor 11' are connected to the A/D converter 301, the vacuum switch 10 and a crank angle sensor 13' are connected to the I/O interface 302, an the EBCV 7 is connected to the I/O interface 302 via the D/A converter 307 and the output circuit 308. In FIG. 3, a coolant temperature sensor 11' is substituted for the coolant temperature switches 11, 12 and a crank angle sensor 13' is substituted for the igniter 13 as shown in FIG. 2.

Interruptions occur at the CPU 303, when the A/D converter 301 completes an A/D conversion and generates an interrupt signal; when the I/O interface 302 receives a pulse signal from the crank angle sensor 13'; and when the clock generator 306 generates a special clock signal.

The coolant temperature data THW is fetched by an A/D conversion routine(s) executed at predetermined time periods and is then stored in the RAM 305. That is, the data THW in the RAM 305 is renewed at predetermined time periods. The engine speed data Ne is calculated by an interrupt routine executed at 30° CA, i.e., at every pulse signal of the crank angle sensor 13', and is then stored in the RAM 305.

The operation of the control circuit 8 of FIG. 2 will be explained with reference to the flow charts of FIGS. 4 and 5.

Figure 4:
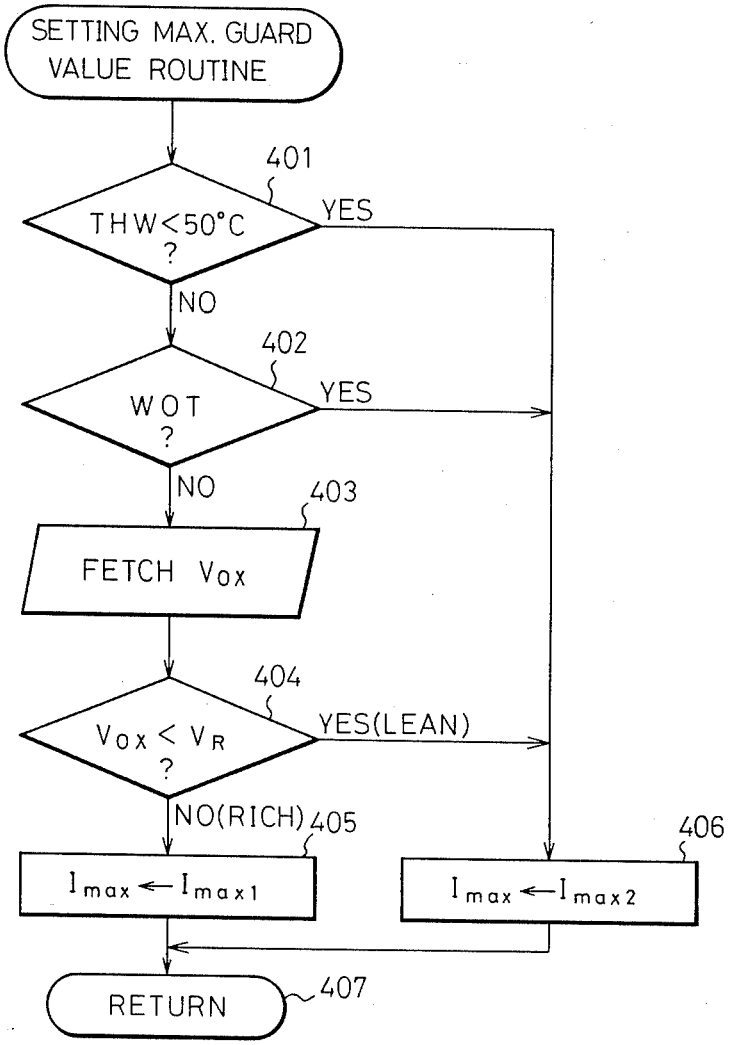
FIGS. 4 and 5 are flowcharts showing the operation of the control circuit of FIG. 1.

FIG. 4 is a routine for setting the maximum guard value $I_{max}$ of the amount of air bleeding executed at a predetermined time period. At step 401, the data of the coolant temperature THW is read out from the RAM 035, and it is determined whether or not the temperature THW is smaller than a predetermined temperature such as 50° C. If THW<50° C. (the engine is cold), the control proceeds to step 406, but is THW≧50° C. (the engine is warm), the control proceeds to step 402. At step 402, the data from the vacuum switch 10 is fetched, and it is determined whether or not the engine is under a full load or heavy load, i.e., wide open throttle (WOT) state. If the engine is not at the WOT state, the control proceeds to step 403, but if the engine is at the WOT state, the control proceeds to step 406.

At step 403, the output $V_{OX}$ of the $O_2$ sensor 9 is fetched after being A/D converted, and it is determined whether or not the output $V_{OX}$ is smaller than a reference value V R (=0.45 V). If $V_{OX}<V_R$ (the air-fuel ratio is lean), the control proceeds to step 406, but if $V_{OX}\geqq V_R$ (the air-fuel ratio is rich), the control proceeds to step 405.

In this way, when THW≧50° C., the engine is not at the WOT state, and $V_{OX}\geqq V_R$, i.e., when the engine is not cold, the engine is not under a full or heavy load, and the air-fuel ratio is rich, the control proceeds to step 405 in which the maximum guard value $I_{max}$ of the amount of air bleeding is set to $I_{max1}$. When THW<50° C., the engine is at the WOT state, or $V_{OX}<V_R$, i.e., when the engine is cold, the engine under a full or heavy load, or the air-fuel ratio is lean, the control proceeds to step 406 in which the maximum guard value $I_{max}$ of the amount of air bleeding is set to $I_{max2}$ which is smaller than $I_{max1}$. This routine is completed at step 407, and thus the maximum guard value $I_{max}$ of the amount of air bleeding is set.

Figure 5:
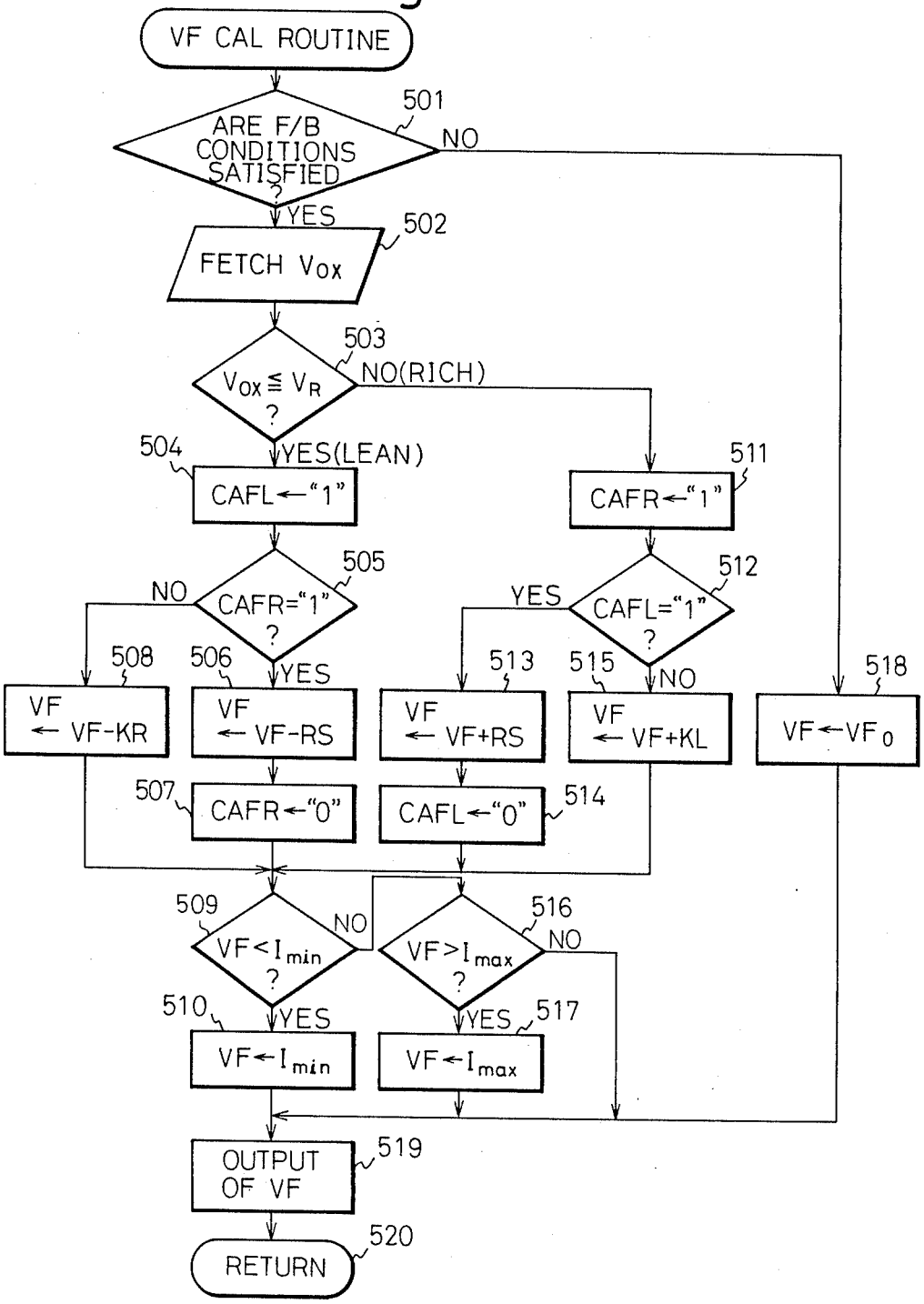

FIG. 5 is a routine for calculating the amount of air bleeding VF executed at a predetermined time period. At step 501, it is determined whether or not all the feedback control (closed-loop-control) conditions are satisfied. The control conditions are, for example, as follows:

(1) the coolant temperature THW is higher than 50° C.;

(2) the rotational speed Ne of the engine is within the range of $N_1$–$N_2$;

(3) a predetermined time has passed after the throttle valve 23 is open from the fully closed position;

(4) the $O_2$ sensor 9 is active;

(5) a fuel cut-off is not carried out,

Of course, other feedback conditions are introduced as occasion demands. However, an explanation of such other feedback control conditions is omitted here.

If at lest one of the feedback control conditions is not satisfied, the control proceeds to step 518 in which the amount of air bleeding VF is made a predetermined value of VFo which corresponds to the amount of air bleeding at the base air-fuel ratio. The base air-fuel ratio is predetermined to be on the rich side of the air-fuel ratio, as explained before. Then the control proceeds to step 519 in which the amount of air bleeding VF is output. Contrary to this, if all the feedback control conditions are satisfied at step 501, the control proceeds to step 502. At step 502, the data $V_{OX}$ from the $O_2$ sensor 9 is fetched after A/D conversion, and the control then proceeds to step 503.

At step 503, the output data $V_{OX}$ of the $O_2$ sensor 9 stored in the RAM 305 is compared with the comparison reference value $V_R$, thereby determining whether the current air-fuel ratio is on the rich side or on the lean side with respect to the aimed air-fuel ratio. If $V_{OX}\leqq V_R$ and the current air-fuel ratio is on the lean side, the control proceeds to step 504 in which a skip flag CAFL is set, i.e., CAFL←"1". Note that the skip flag CAFL is used for a skip operation when a first change from the lean side to the rich side occurs in the controlled air-fuel ratio.

At step 505, it is determined whether or not a skip flag CAFR is "1". Note that the skip flag CAFR is used for a skip operation when a first change from the rich side to the lean side occurs in the controlled air-fuel ratio. As a result, if the flag CAFR is "1", the control proceeds to step 506, which decreases the amount of air bleeding VF by a relatively large amount RS. Then, at step 507, the skip flag CAFR is cleared, i.e., CAFR←"0". Thus, when the control at step 503 is further carried out, the control proceeds to step 508, which decreases the amount of air bleeding VF by a relatively small amount KR. Here, RS is a constant for a skip operation which remarkably decreases the amount of air bleeding VF when a first change from the rich side ($V_{OX}>V_R$) to the lean side ($V_{OX}\leqq Va_r$) occurs in the controlled air-fuel ratio, and KR is a constant for an integration operation which gradually decreases the amount of air bleeding VF when the controlled air-fuel ratio is on the lean side. After the step 507 or 508, the control then proceeds to step 509.

On the other hand, at step 503, if $V_{OX}>V_R$ so that the current air-fuel ratio is on the rich side, the control proceeds to step 511 in which a skip flag CAFR is set, i.e., CAFR←"1". Then at step 512, it is determined whether or not a skip flag CAFL is "1". As a result, if the flag CAFL is "1", the control proceeds to step 513, which increases the amount of air bleeding VF by a relatively large amount RS. Then, at step 514, the skip flag CAFL is cleared, i.e., CAFL←"0". Thus, when the control at step 512 is further carried out, the control then proceeds to step 515, which increases the amount of air bleeding VF by a relatively small amount KL. Here, RS is a constant for a skip operation which remarkably decreases the amount of air bleeding VF when a first change from the lean side ($V_{OX}\leqq V_R$) to the rich side ($V_{OX}>V_R$) occurs in the controlled air-fuel ratio, and KL is a constant for an integration operation which gradually increases the amount of air bleeding VF when the controlled air-fuel ratio is on the rich side. After the step 514 or 515, the control then proceeds to step 509.

At step 509, it is determined whether or not the amount of air bleeding VF is smaller than the minimum guard value $I_{min}$. If $VF<I_{min}$, the control proceeds to step 510 and the amount of air bleeding VF is replaced by the minimum guard value $I_{min}$ and the control then proceeds to step 519, but if $VP\geqq I_{min}$, the control proceeds to step 516.

As step 516, it is determined whether or not the amount of air bleeding VF is larger than the maximum guard value $I_{max}$. If $VF>I_{max}$, the control proceeds to step 517 and the amount of air bleeding VF is replaced by the maximum guard value $I_{max}$ and the control then proceeds to step 519, but if $VF\leqq I_{max}$, the control proceeds directly to step 519.

At step 519, the amount of air bleeding VF is sent to the output circuit 308, and the EBCV 7 is controlled according to the amount of air bleeding VF.

Figure 6A:
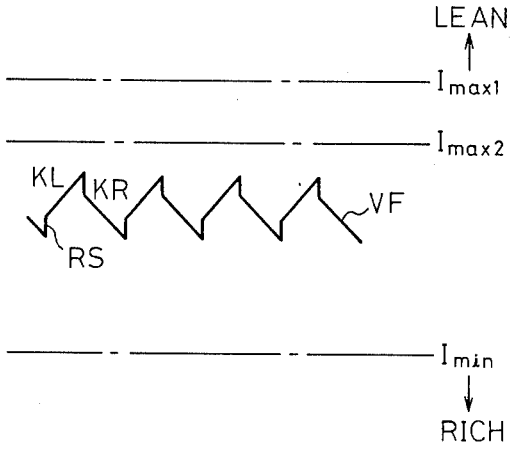
FIG. 6A and FIG. 6B are graphs explaining the effect of the present invention.
Figure 6B:
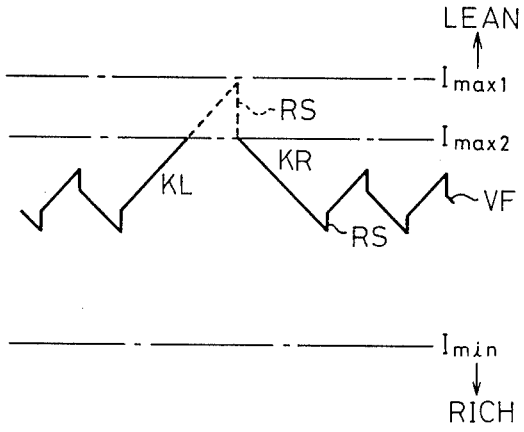

FIG. 6A and 6B shows the effect of the present invention. In FIG. 6A and 6B, KL shows a lean integration value by which the amount of air bleeding is gradually increased, KR shows a rich integration value by which the amount of air bleeding is gradually decreased and RS shows a skip amount by which the amount of air bleeding is rapidly increased.

When the amount of air bleeding VF is controlled within the maximum guard value $I_{max2}$ and the minimum guard value $I_{min}$ as shown in FIG. 6A, the controlled air-fuel ratio will not be overlean in accordance with the present invention or in accordance with the prior art. Contrary to this, when the amount of air bleeding VF exceeds the value of $I_{max2}$, as shown by a dotted line RS in FIG. 6B, under the conditions of a cold engine or a full or heavy load on the engine, the controlled air-fuel ratio will not become overlean in accordance with the present invention, but the controlled air-fuel ratio will become base air-fuel ratio which makes the driveability at acceleration state and the full or heavy load state of the engine and the fuel consumption worse in accordance with the prior art. That is, in the present invention, the maximum guard value $I_{max1}$ of an amount of air bleeding is set to a small value of $I_{max2}$, when the engine is cold, the engine is in an acceleration state, or the air-fuel ratio is lean, and the air-fuel ratio feedback control is not interrupted when the engine is in those states. In this way, in the present invention, the amount of air bleeding is limited by the maximum guard value $I_{max2}$ and the air-fuel ratio will not become excessively lean.

I claim:

1. A method for controlling the air-fuel ratio in an internal combustion engine having a carburetor and a throttle valve in an intake air passage thereof, comprising the steps of:

determining whether said engine is cold;

determining whether said engine is under a full or heavy load;

detecting an air-fuel ratio of said engine;

setting a first maximum guard value of an amount of air bleeding when said engine is not cold, said engine is not under a full or heavy load, and said air-fuel ratio is rich;

setting a second maximum guard value of the amount of air bleeding which is smaller than said first maximum guard value, when said engine is cold, said engine is under a full or heavy load, or said air-fuel ratio is lean;

calculating the amount of air bleeding in accordance with said detected air-fuel ratio;

guarding the amount of air bleeding by said first maximum guard value when said engine is not cold, said engine is not under a full or heavy load, and said air-fuel ratio is rich;

guarding the amount of air bleeding by said second maximum guard value when said engine is cold, said engine is under a full or heavy load, or said air-fuel ratio is lean;

adjusting said air-fuel ratio by supplying the amount of air bleeding after guarding by said first or second maximum guard value.

2. A method as set forth in claim 1, wherein said amount of air bleeding calculating step comprises the steps of:

gradually decreasing said amount of air bleeding when the detected air-fuel ratio is on the lean side;

gradually increasing said amount of air bleeding when the detected air-fuel ratio is on the rich side;

greatly decreasing said amount of air bleeding when the detected air-fuel ratio is switched from the rich side to the lean side; and greatly increasing said amount of air bleeding when the detected air-fuel ratio is switched from the lean side to the rich side.

3. An apparatus for controlling the air-fuel ratio in an internal combustion engine having a carburetor and a throttle valve in an intake air passage thereof, comprising:

means for determining whether said engine is cold;

means for determining whether said engine is under a full or heavy load;

means for detecting an air-fuel ratio of said engine;

means for setting a first maximum guard value of an amount of air bleeding when said engine is not cold, said engine is not under a full or heavy load, and said air-fuel ratio is rich;

means for setting a second maximum guard value of the amount of air bleeding which is smaller than said first maximum guard value, when said engine is cold, said engine is under a full or heavy load, or said air-fuel ratio is lean;

means for calculating the amount of air bleeding in accordance with said detected air-fuel ratio;

means for guarding the amount of air bleeding by said first maximum guard value when said engine is not cold, said engine is not under a full or heavy load, and said air-fuel ratio is rich;

means for guarding the amount of air bleeding by said second maximum guard value when said engine is cold, said engine is under a full or heavy lord, or said air-fuel ratio is lean;

means for adjusting said air-fuel ratio by supplying the amount of air bleeding after guarding by said first or second maximum guard value.

4. An apparatus as set forth in claim 3, wherein said amount of air bleeding calculating means comprises:

means for gradually decreasing said amount of air bleeding when the detected air-fuel ratio is on the lean side;

means for gradually increasing said amount of air bleeding when the detected air-fuel ratio is on the rich side;

means for greatly decreasing said amount of air bleeding when the detected air-fuel ratio is switched from the rich side to the lean side; and means for greatly increasing said amount of air bleeding when the detected air-fuel ratio is switched from the lean side to the rich side.

* * * * *